US005454129A

United States Patent [19]

Kell

[11] Patent Number: 5,454,129

[45] Date of Patent: Oct. 3, 1995

[54] SELF-POWERED POOL VACUUM WITH REMOTE CONTROLLED CAPABILITIES

[76] Inventor: Richard T. Kell, 1000 N. Lemoore Ave. #47, Lemoore, Calif. 93245

[21] Appl. No.: 299,341

[22] Filed: Sep. 1, 1994

[51] Int. Cl.[6] ..... E04H 4/16

[52] U.S. Cl. ..... 15/1.7; 15/319

[58] Field of Search ..... 15/1.7, 319

[56] References Cited

U.S. PATENT DOCUMENTS

| | | | |
|---|---|---|---|
| 3,906,572 | 9/1975 | Winn | 15/1.7 |
| 4,270,484 | 6/1981 | Shimatani et al. | 15/1.7 |
| 4,306,329 | 12/1981 | Yokoi | 15/319 |
| 4,369,543 | 1/1983 | Chen et al. | 15/319 |
| 4,518,437 | 5/1985 | Sommer | 15/1.7 |
| 5,256,207 | 10/1993 | Sommer | 15/1.7 |

*Primary Examiner*—Edward L. Roberts, Jr.

[57] ABSTRACT

A self-powered pool vacuum with remote controlled capabilities. The vacuum including a head having a lower base in a generally rectangular configuration with side openings extending vertically therethrough and an enlarged leading edge. The head also includes an intermediate cover positionable over the base with a central aperture extending therethrough with an apertured peripheral flange and a gasket positionable between the flange and the base. Also included is a top cover positionable over the intermediate cover and base for constituting a plenum zone. The top cover includes an aperture for coupling to a suction hose and an antennae extending upwardly therefrom. A brush is peripherally positionable downwardly from the lower face of the base. Parallel axles extending transversely through the base with drive wheels on one of the axles. Steering wheels are pivotally coupled to others of the axles with a steering rod for pivoting the wheels to change directions. A drive motor is within the housing to rotate the drive wheels. A steering motor is provided for axially shifting the steering rods. A receiver is within the base to drive the steering motor in one direction or another in response to signals from the antennae and receiver.

4 Claims, 4 Drawing Sheets

FIG. 4
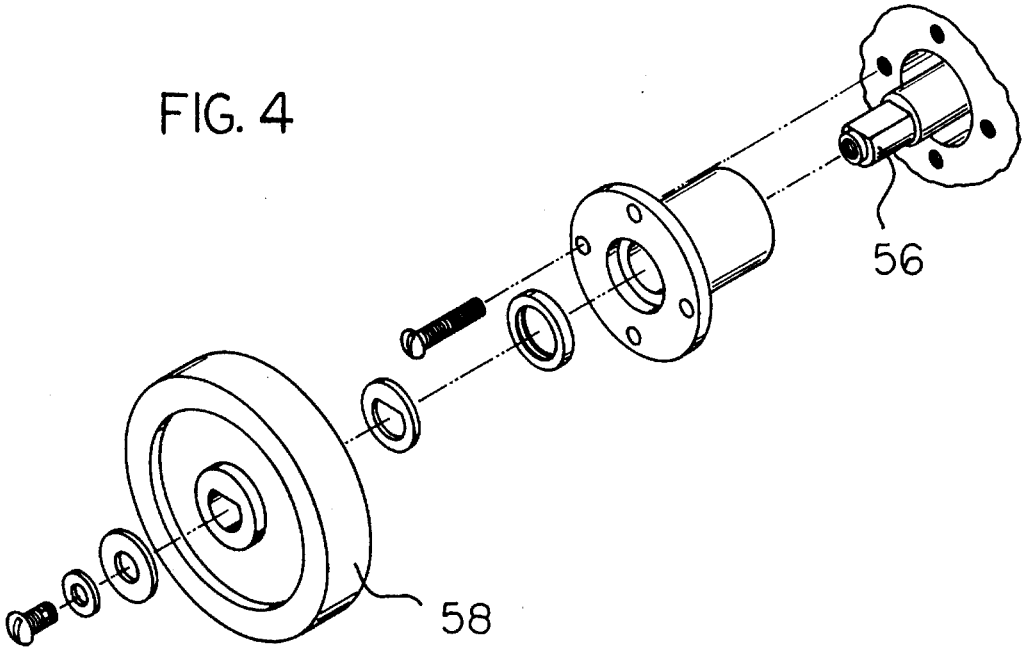
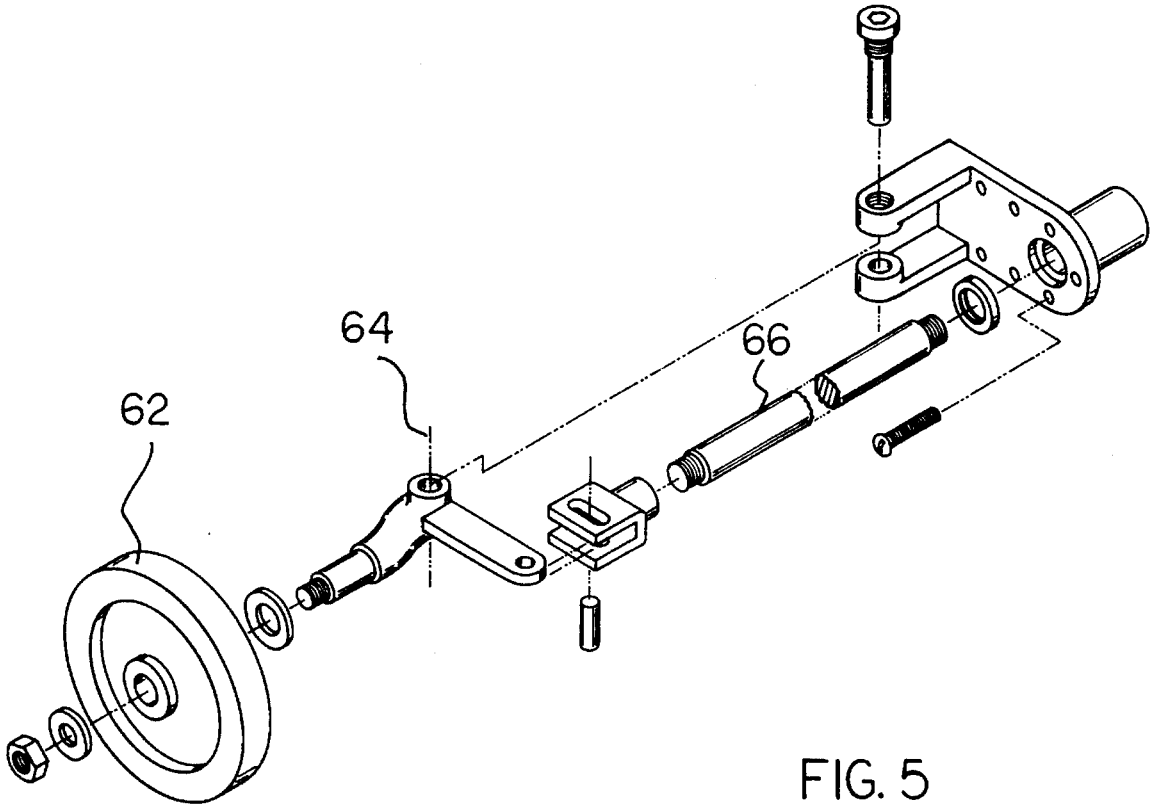
FIG. 5

SELF-POWERED POOL VACUUM WITH REMOTE CONTROLLED CAPABILITIES

BACKGROUND OF THE INVENTION

1. Field of the Invention

The present invention relates to self-powered pool vacuum with remote controlled capabilities and more particularly pertains to cleaning the bottoms of swimming pools with a self-powered cleaning head and controls for cleaning in either an automatic mode or in response to a control mechanism operated by a user outside of the pool.

2. Description of the Prior Art

The use of pool cleaning devices of various designs and constructions including manual and automatic controls therefor is known in the prior art. More specifically, pool cleaning devices of various designs and constructions including manual and aromatic controls therefor heretofore devised and utilized for the purpose of cleaning pools either manually or by pre-programmed mode through various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 5,095,571 to Sargent discloses an underwater vacuum cleaner.

U.S. Pat. No. 5,093,950 to Heier discloses a self-propelled vacuum drive swimming pool cleaner.

U.S. Pat. No. 4,718,129 to Miller discloses a swimming pool vacuum apparatus.

U.S. Pat. No. 3,547,458 to Price discloses a steering attachment for a swimming pool vacuum head.

U.S. Pat. No. 3,430,277 to Ortega discloses an automatic vacuum pool cleaner.

In this respect, the self-powered pool vacuum with remote controlled capabilities according to the present invention substantially departs from the conventional concepts and designs of the prior art, and in so doing provides an apparatus primarily developed for the purpose of cleaning the bottoms of swimming pools with a self-powered cleaning head and controls for cleaning in either an automatic mode or in response to a control mechanism operated by a user outside of the pool.

Therefore, it can be appreciated that there exists a continuing need for new and improved self-powered pool vacuum with remote controlled capabilities which can be used for cleaning the bottoms of swimming pools with a self-powered cleaning head and controls for cleaning in either an automatic mode or in response to a control mechanism operated by a user outside of the pool. In this regard, the present invention substantially fulfills this need.

SUMMARY OF THE INVENTION

In view of the foregoing disadvantages inherent in the known types of pool vacuums now present in the prior art, the present invention provides an improved self-powered pool vacuum with remote controlled capabilities. As such, the general purpose of the present invention, which will be described subsequently in greater detail, is to provide a new and improved self-powered pool vacuum with remote controlled capabilities apparatus and method which has all the advantages of the prior art and none of the disadvantages.

To attain this, the present invention essentially comprises a new and improved self-powered pool vacuum with remote controlled capabilities comprising, in combination a head having a lower base in a generally rectangular configuration with side openings extending vertically therethrough and an enlarged leading edge, the head also including an intermediate cover positionable over the base with a central aperture extending therethrough and an apertured peripheral flange with a gasket positionable between the flange and the base for the coupling therebetween and the head also including a top cover positionable over the intermediate cover and base for constituting a plenum zone for the withdrawing of air and water from the leading edge of the base, the top cover including an aperture for coupling to a suction hose and an antennae extending upwardly therefrom, the periphery of the base and top cover being coextensive with the periphery of the intermediate base being interiorly thereof; a brush peripherally positionable downwardly from the lower face of the base; parallel axles extending transversely through the base with drive wheels on one of the axles and steering wheels pivotally coupled to others of the axles with a steering rod for pivoting the wheels to change directions, the wheels extending downwardly to an elevation essentially equal to the lower edge of the brushes; a drive motor within the housing for rotating the drive axle to rotate the drive wheels to move the head along the floor of a pool for cleaning purposes; a steering motor with an output shaft having a pinion gear and a rack for axially shifting the steering rods; a receiver within the base coupled between the antennae and the steering motor to drive the steering motor and rack in one direction or another in response to signals from the antennae and receiver; a battery sealed within the base for powering the drive motor and the steering motor and the receiver; and a control mechanism with an upstanding joy stick extending in a vertical orientation and movable to an angular orientation at the discretion of a user, the face of the control mechanism including indicia for movement of the joy stick forwardly, rearwardly, left, right or an off position for inactivating the drive of the head and an automatic position for allowing the movement of the head in a pre-programmed manner, the control mechanism also including an off/on switch.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved self-powered pool vacuum with remote controlled capabilities which has all the advantages of the prior art pool cleaning devices of various designs and constructions and none of the disadvantages.

It is another object of the present invention to provide a new and improved self-powered pool vacuum with remote controlled capabilities which may be easily and efficiently manufactured and marketed.

It is a further object of the present invention to provide a new and improved self-powered pool vacuum with remote controlled capabilities which is of a durable and reliable construction.

An even further object of the present invention is to provide a new and improved self-powered pool vacuum with remote controlled capabilities which is susceptible of a low cost of manufacture with regard to both materials and labor, and which accordingly is then susceptible of low prices of sale to the consuming public, thereby making such pool vacuum devices economically available to the buying public.

Still yet another object of the present invention is to provide a new and improved self-powered pool vacuum with remote controlled capabilities which provides in the apparatuses and methods of the prior art some of the advantages thereof, while simultaneously overcoming some of the disadvantages normally associated therewith.

Lastly, it is an object of the present invention to provide new and improved self-powered pool vacuum with remote controlled capabilities comprising a head having a lower base in a generally rectangular configuration with side openings extending vertically therethrough and an enlarged leading edge, the head also including an intermediate cover positionable over the base with a central aperture extending therethrough and an apertured peripheral flange with a gasket positionable between the flange and the base for the coupling therebetween and the head also including a top cover positionable over the intermediate cover and base for constituting a plenum zone for the withdrawing of air and water from the leading edge of the base, the top cover including an aperture for coupling to a suction hose and an antennae extending upwardly therefrom, the periphery of the base and top cover being coextensive with the periphery of the intermediate base being interiorly thereof; a brush peripherally positionable downwardly from the lower face of the base; parallel axles extending transversely through the base with drive wheels on one of the axles and steering wheels pivotally coupled to others of the axles with a steering rod for pivoting the wheels to change directions, the wheels extending downwardly to an elevation essentially equal to the lower edge of the brushes; a drive motor within the housing for rotating the drive axle to rotate the drive wheels to move the head along the floor of a pool for cleaning purposes; a steering motor with an output shaft having a pinion gear and a rack for axially shifting the steering rods; a receiver within the base coupled between the antennae and the steering motor to drive the steering motor and rack in one direction or another in response to signals from the antennae and receiver.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an exploded perspective view of one of the drive wheels of the device of the prior Figures.

FIG. 5 is an exploded perspective view of one of the steering wheels shown in FIGS. 1, 2 and 3.

The same reference numeral refers to the same part throughout the various figures.

DESCRIPTION OF THE PREFERRED EMBODIMENT

Figure 1:
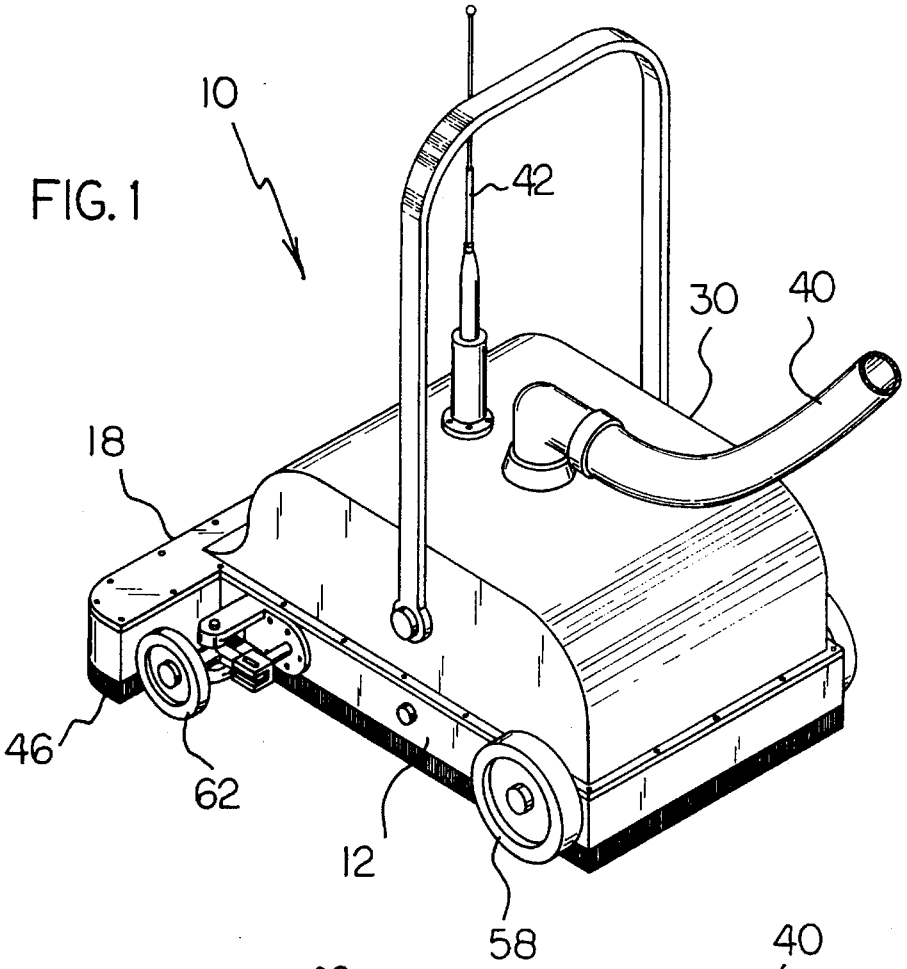
FIG. 1 is a perspective view of the preferred embodiment of the self-powered pool vacuum with remote controlled capabilities constructed in accordance with the principles of the present invention.
Figure 2:
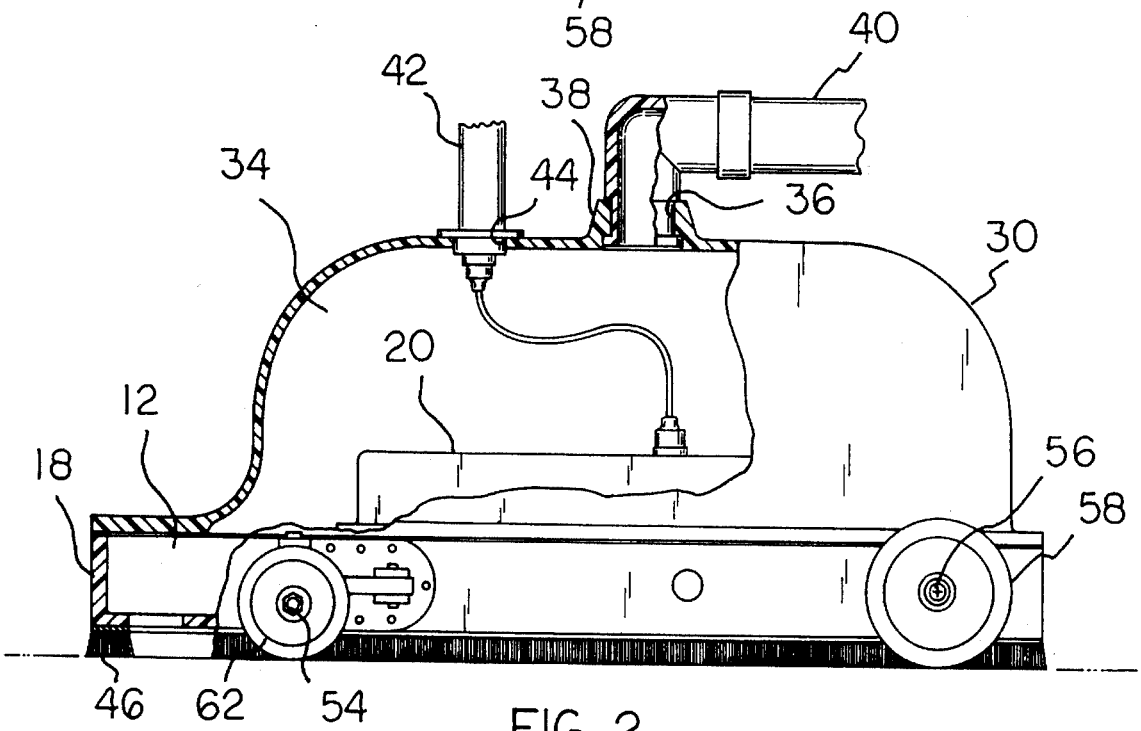
FIG. 2 is a side elevational view of the device shown in FIG. 1 with parts broken away to show certain internal constructions thereof.
Figure 3:
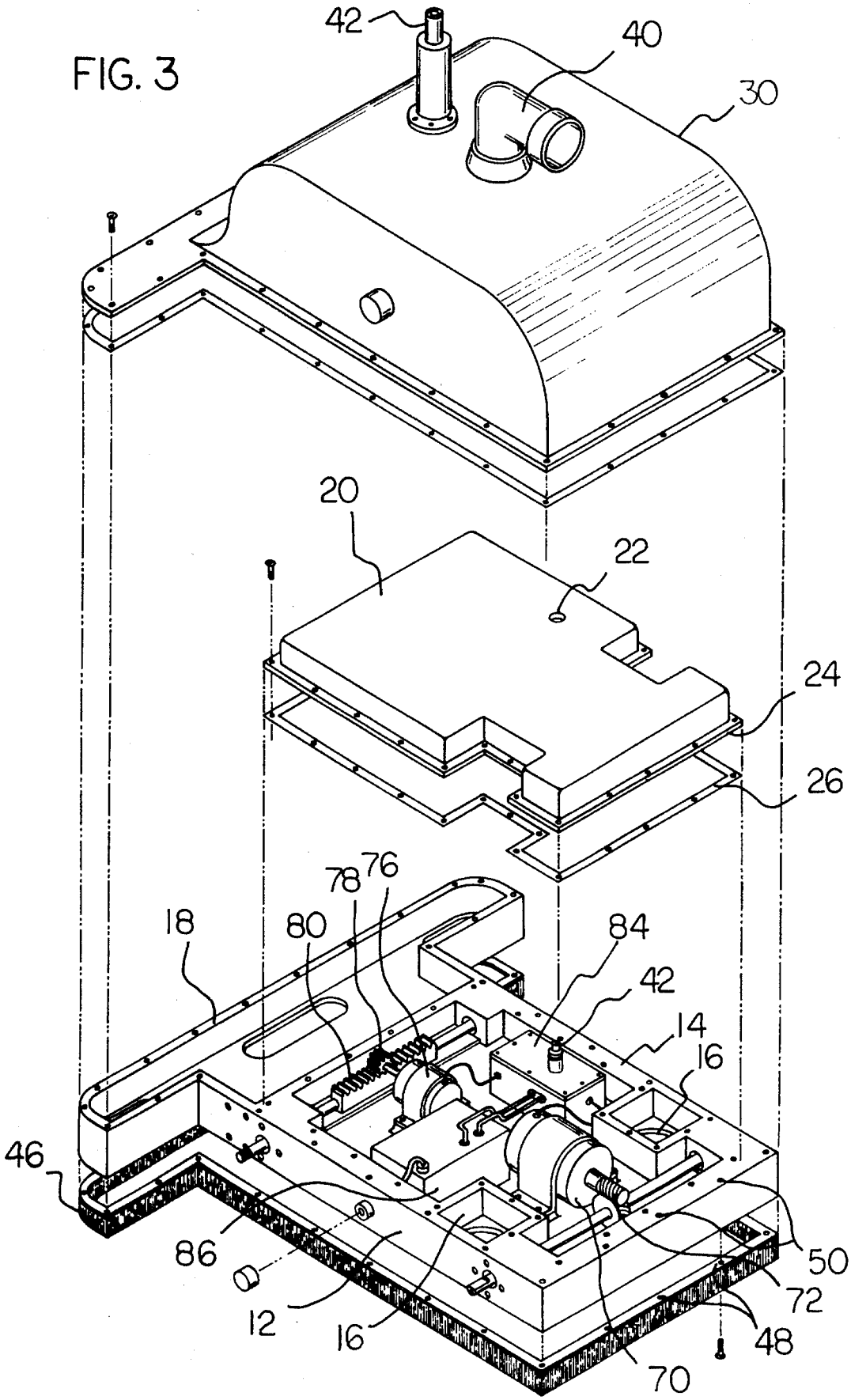
FIG. 3 is an exploded perspective view of the device shown in FIGS. 1 and 2.
Figure 6:
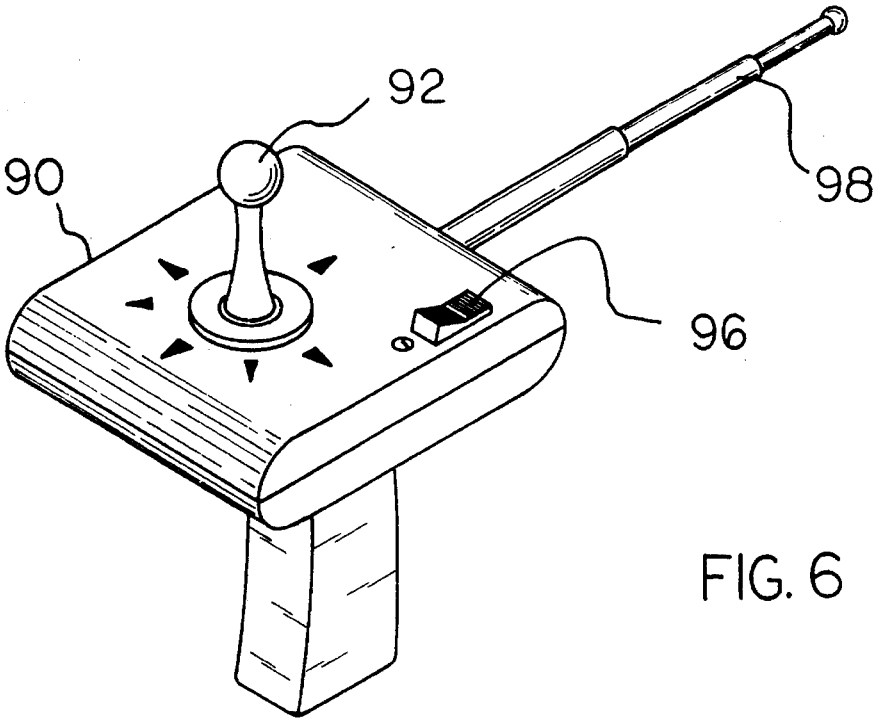
FIG. 6 is a perspective view of the control mechanisms for the device of the prior Figures.
Figure 7:
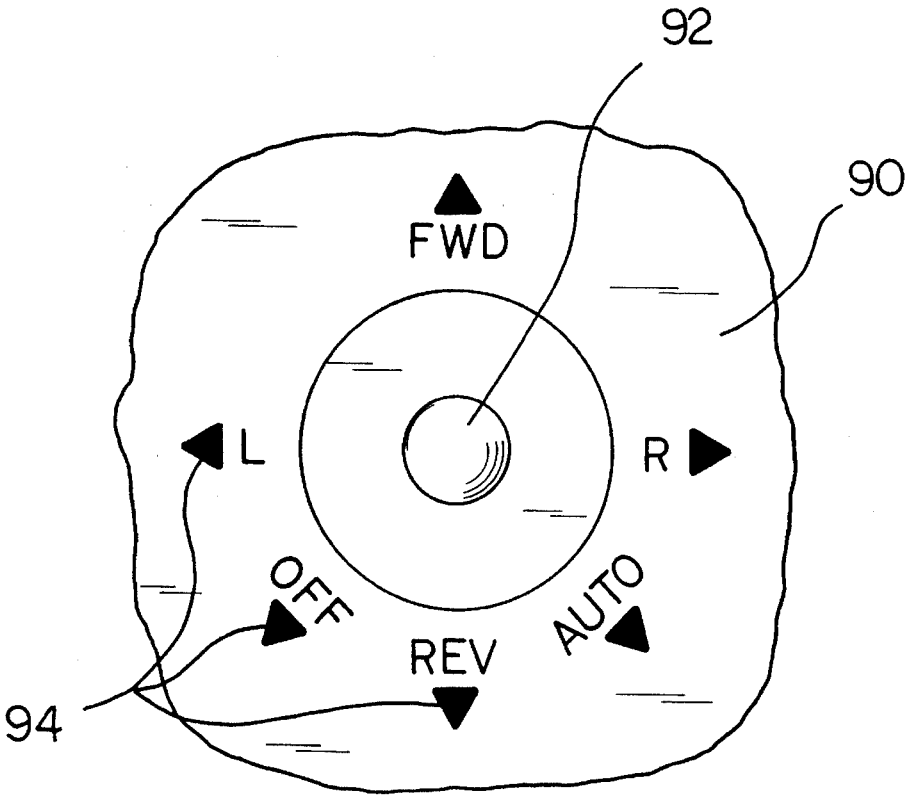
FIG. 7 is a top elevational view of the joy stick control for the control mechanism of FIG. 6 illustrating the various positions for the joy stick.

With reference now to the drawings, and in particular to FIG. 1 thereof, a new and improved self-powered pool vacuum with remote controlled capabilities embodying the principles and concepts of the present invention and generally designated by the reference numeral 10 will be described.

The present invention, the new and improved self-powered pool vacuum with remote controlled capabilities is comprised of a plurality of component elements. Such component elements in their broadest context, include a head, a brush, parallel axles, a drive motor, a steering motor, a receiver, a battery and a control mechanism. Such components are individually configured and correlated with respect to each other so as to attain the desired objectives.

The principal component of the system 10 of the present invention is a head 12. The head has a lower base 14 in a generally rectangular configuration. The lower base has side openings 16 extending vertically through the lower base. The head also has an enlarged leading edge 18. The head also includes an intermediate cover 20. The intermediate cover is positionable over the base and has a central aperture 22 extending there through. The intermediate cover also has an apertured peripheral flange 24 with a gasket 26. The gasket is positionable between the flange and the base for the coupling together of such two components.

The head 12 also includes a top cover 30. The top cover is positionable over the intermediate cover and base. Above the intermediate cover and beneath the top cover is a plenum zone 34. The plenum zone is for the withdrawing of air and water from the leading edge of the base. The top cover also includes an aperture 36 with a flange 38 for coupling with a suction hose 40. In addition, an antenna 42 extends upwardly from a supplemental aperture 44. The periphery of the base and top cover are to coextensive with the periphery of the intermediate base being located interiorly of those components above and below.

The next component of the system is a brush 46. The brush is peripherally positioned to extend downwardly from the lower base. It is preferably coupled thereto through apertures 48 on the upper surface of the base coupling with associated apertures 50 around the periphery of the lower base.

Parallel axles 54, 56 extend transversely through the base. The rearmost axle 56 are a pair of drive wheels 58. Appropriate conventional coupling mechanism provide couplings between the drive wheels and provide flat surfaces 60 on the axles 62 which mate with corresponding flat surfaces on its associated wheels. Such drive wheels are preferably solid rubber tires for improved traction. One drive wheel is located at each end of the axle on opposite sides of the lower base.

Cooperatively associated with the drive wheels are a pair of steering wheels 62. The steering wheels are individually coupled about a vertical axles 64 for varying direction of motion of the device. A steering rod 64 couples the wheel 62 and axle 54 for pivoting the wheels to change direction. This is done through an appropriate combination of conventional linkage components as shown in FIG. 5. All four of the wheels 58 and 60 extend downwardly to an elevational orientation essentially to the lower edge of the brushes.

A drive motor 70 is located in the lower base. The drive motor functions to provide the motive force to the device for cleaning and includes an arrangement of components 72 to rotate the drive wheels. This function is to move the lower base along the floor or the pool for cleaning purposes. Activation and inactivation of the drive motor and other components will be described here and after.

An additional motor, a steering motor 76, is provided with an output shaft having a pinion gear 78, Such pinion gear functions an association with a rack 80 for movement transversely with respect to the direct of motion of the device. Such is used for directing the turning of the wheels 62 through steering rod 66 to insure proper directional motion of the device.

Also located within the head is a receiver 84. The receiver is electrically coupled to the antenna 42 located thereabove. It is also electrically coupled to the steering motor 76 to drive the steering motor as well as the rack in one direction or another in response to signals from the antenna and receiver. The drive motor 70 is also coupled to the receiver 84 for effecting its energization to provide the forward motion of the device during the cleaning activity.

In association with the receiver and motors is a battery 86. The battery is in a sealed container within the base. Its function is for providing electrical potential to power the drive motor and the steering motor during operation and use. It also functions to power the receiver so that it may receive the instructional information for utilizing the device.

The last component of the system 10 of the present invention is a control mechanism 90. The control mechanism is provided with an upstanding joy stick 92. Such joy stick extends in a generally vertical orientation. It is movable to any angular orientation at the discretion of the user. The face of the control mechanism also includes indicia 94. Such indicia is in the nature of the markings L and R to indicate whether a user wishes to have the device moved to the left or the right. The indicia also includes a FWD and a REV to indicate whether the user wishes the device to move forwardly or in a reverse manner. Other two components are an OFF sentences to turn off the device. The last form of indicia is AUTO sentence this is to automatically position the device for movement in a predetermined travel mode, as for example a random travel mode to clean all areas of the pool in which the device is located.

When the joy stick is turned to the off position and allowed to return vertical as by a spring mechanism, the device will remain inoperative. This condition will be maintained until the joy stick is moved to an alternate position whether forward, reverse, left, right or the like as well as automatic as may be desired by the user. Joy sticks are conventional, Their configuration is a function of the number of activities one may wish to be preformed by such joy stick. Such joy stick also has an ON/OFF switch 96. It also has a transmitter and an antenna 98 which is extendable to allow communication between the control mechanism and the appropriate control components in the receiver 84.

The present invention provides a better way to clean a swimming pool. It is a self-powered unit that can crawl along and vacuum, and is controlled in real time by a person outside of the pool. It eliminates the energy, control, and patience required to clean a pool manually while it enables a person to guide the unit so as to clean all areas an unattended robot might miss. The present invention can also operate in an unguided, random path mode.

The present invention consists of a pool cleaning unit and a controller. The cleaning unit is 11 inches high and 12 inches wide, with the flat bottom that has a stiff brush around its periphery. It uses the circulation pump to provide a vacuum, and is connected to the pump by a hose. The brush scrubs the liner and helps maintain the suction between the unit and the liner. Two round projections on opposite sides of the unit fit into the circular ends of a U-shaped handle that is used to lift the unit in and out of the pool.

The cleaning unit preferably contains a ⅓ horsepower DC motor and reduction gears in a waterproof section which drives a pair of rubber wheels that provide the motive power. The drive motor can run in either direction to go forward or backward, and the front wheels can be turned to go to the left or right. The wheels are turned by a small DC steering motor and reduction gears in another watertight section. The direction and on/off state of both motors are controlled by a 2-channel citizens band radio receiver whose antenna is encased in a waterproof sleeve that extends up from the front of the unit. Electrical power is provided by two 9 volt rechargeable batteries in another waterproof section with the receiver. A watertight plug on the side provides connections to a charger.

The controller consists of a round container that houses a 2-channel citizens band radio control transmitter, a joy stick and a battery. The joy stick projects up from the center of the unit. Electrical power is off when the joy stick is in a detent position all the way back and to the left. Moving it from this position turns power on and allows the joy stick to move to its straight up neutral position. Pushing the joy stick forward turns the drive motor on in the reverse direction. Pushing the joy stick to the right turns the wheels right, and pushing it left turns them to the left. Pulling the joy stick back and to the right places it in the automatic mode decent, in which the cleaning unit moves forward until it hits an obstruction, when it reverses and changes course a small amount.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved self-powered pool vacuum with remote controlled capabilities comprising, in combination:

a head having a lower base in a generally rectangular configuration having a closed bottom portion and upwardly extending side portions with passageways adjacent said side portions and extending through said bottom portion and extending to the upper edge of said side portions and an enlarged leading edge, the head also including an intermediate cover positionable over the base except for the passageways and an apertured peripheral flange with a gasket positionable between the flange and the base for the coupling therebetween, said intermediate cover forming with said bottom and side portions of said lower base an enclosed chamber and the head also including a top cover positionable over the intermediate cover and base for constituting a plenum zone for the withdrawing of air and water through said passageways, the top cover including an aperture for coupling to a suction hose and an antennae extending upwardly therefrom, the periphery of the base and top cover being coextensive, with the periphery of the intermediate cover being interiorly thereof;

a brush peripherally positionable downwardly from the lower face of the base;

parallel axles extending transversely from said chamber through the side portions of said chamber with drive wheels on one of the axles and steering wheels pivotally coupled to others of the axles with a steering rod for pivoting the wheels to change directions, the wheels extending downwardly to an elevation essentially equal to the lower edge of the brushes;

a drive motor within the enclosed chamber for rotating the drive axle to rotate the drive wheels to move the head along the floor of a pool for cleaning purposes;

a steering motor within said enclosed chamber with an output shaft having a pinion gear and a rack for axially shifting the steering rods;

a receiver within the enclosed chamber coupled between the antennae and the steering motor to drive the steering motor and rack in one direction or another in response to signals from the antennae and receiver;

a battery sealed within the base for powering the drive motor and the steering motor and the receiver; and a control mechanism with an upstanding joy stick extending in a vertical orientation and movable to an angular orientation at the discretion of a user, the face of the control mechanism including indicia for movement of the joy stick forwardly, rearwardly, left, right or an off position for inactivating the drive of the head and an automatic position for allowing the movement of the head in a pre-programmed manner, the control mechanism also including an off/on switch.

2. A self-powered pool vacuum with remote controlled capabilities comprising:

a head having a lower base in a generally rectangular configuration having a closed bottom portion and upwardly extending side portions with passageways adjacent said side portions and extending through said bottom portion and extending to the upper edge of said side portions and an enlarged leading edge, the head also including an intermediate cover positionable over the base except for the passageways and an apertured peripheral flange with a gasket positionable between the flange and the base for the coupling therebetween, said intermediate cover forming with said bottom and side portions of said lower base an enclosed chamber, and the head also including a top cover positionable over the intermediate cover and base for constituting a plenum zone for the withdrawing of air and water through said passageways, the top cover including an aperture for coupling to a suction hose and an antennae extending upwardly therefrom, the periphery of the base and top cover being coextensive with, the periphery of the intermediate cover being interiorly thereof;

a brush peripherally positionable downwardly from the lower face of the base;

parallel axles extending transversely from said chamber through the side portions of said chamber with drive wheels on one of the axles and steering wheels pivotally coupled to others of the axles with a steering rod for pivoting the wheels to change directions, the wheels extending downwardly to an elevation essentially equal to the lower edge of the brushes;

a drive motor within the enclosed chamber for rotating the drive axle to rotate the drive wheels to move the head along the floor of a pool for cleaning purposes;

a steering motor within said enclosed chamber with an output shaft having a pinion gear and a rack for axially shifting the steering rods;

a receiver within the base coupled between the antennae and the steering motor to drive the steering motor and rack in one direction or another in response to signals from the antennae and receiver.

3. The apparatus as set forth in claim 2 and further including:

a source of electrical potential for powering the drive motor and the steering motor and the receiver.

4. The apparatus as set forth in claim 3 and further including:

a control mechanism with an upstanding joy stick extending in a vertical orientation and movable to an angular orientation at the discretion of a user, the face of the control mechanism including indicia for movement of the joy stick forwardly, rearwardly, left, right or an off position for inactivating the drive of the head and an automatic position for allowing the movement of the head in a pre-programmed manner, the control mechanism also including an off/on switch.

* * * * *